US007454806B2

(12) United States Patent
Koch et al.

(10) Patent No.: US 7,454,806 B2
(45) Date of Patent: Nov. 25, 2008

(54) LEG SUPPORT ARRANGEMENT FOR OPERATING TABLES

(75) Inventors: Guido Koch, Karlsruhe (DE); Bernhard Katzenstein, Kirchzarten (DE)

(73) Assignee: Maquet GmbH & Co. KG, Rastatt (DE)

( * ) Notice: Subject to any disclaimer, the term of this patent is extended or adjusted under 35 U.S.C. 154(b) by 176 days.

(21) Appl. No.: 10/534,429

(22) PCT Filed: Sep. 30, 2003

(86) PCT No.: PCT/EP03/10844

§ 371 (c)(1),
(2), (4) Date: May 10, 2005

(87) PCT Pub. No.: WO2004/045482

PCT Pub. Date: Jun. 3, 2004

(65) Prior Publication Data

US 2006/0042011 A1 Mar. 2, 2006

(30) Foreign Application Priority Data

Nov. 19, 2002 (DE) ..... 102 53 906

(51) Int. Cl.
*A61G 13/00* (2006.01)

(52) U.S. Cl. ..... 5/624; 5/619; 5/618

(58) Field of Classification Search ..... 5/618–619, 5/621–624

See application file for complete search history.

(56) References Cited

U.S. PATENT DOCUMENTS 5,157,800 A * 10/1992 Borders ..... 5/602
6,202,230 B1 * 3/2001 Borders ..... 5/618
6,276,012 B2 8/2001 Borders ..... 5/622

* cited by examiner

*Primary Examiner*—Fredrick Conley
(74) *Attorney, Agent, or Firm*—McCormick, Paulding & Huber LLP

(57) ABSTRACT

The invention relates to a leg support arrangement for operating tables comprising two leg supports, connected to a base element of an operating table such that, the above are adjustable between a base position, lying adjacent to each other parallel to the longitudinal mid-axis of the operating table and a spread position with a separation from the longitudinal mid-axis, whereby each leg support is connected to the base element by means of a parallelogram joint, the joint axes (36, 52, 44, 54) of which are arranged perpendicular to the plane of the base element.

5 Claims, 4 Drawing Sheets

LEG SUPPORT ARRANGEMENT FOR OPERATING TABLES

CROSS REFERENCE TO RELATED APPLICATIONS

Applicants hereby claim foreign priority benefits under 35 U.S.C. § 119 of PCT Patent Application No. PCT/EP2003/010844 filed Sep. 30, 2003 and German Patent Application No. 102 53 906.5 filed Nov. 19, 2002, the disclosures of which are herein incorporated by reference.

BACKGROUND OF THE INVENTION

1. Technical Field

The invention concerns a leg support arrangement for operating tables with two leg supports connected with a base element of an operating table so that they are adjustable between a fundamental position in which they lie next to one another parallel to the longitudinal middle axis of the operating table and a spread position in which they are spaced from the longitudinal middle axis of the operating table.

2. Background Art

In all operating procedures in which the operator moves into the foot-end of the operation field the legs of the patient lying on the operating table must be spread. In customary operating tables the leg supports are linked to the base element by means of spreading joints for pivotal movement about axes perpendicular to the operating table support surface, so that the leg supports can be pivoted about the spreading joints near the hips to provide a free space in the middle region between the leg supports. Although as a rule recesses are provided on the edges of the leg supports facing one another near the base element, the free space existing between the spread leg supports is not sufficient for all applications.

SUMMARY OF THE INVENTION

The invention has as its object the provision of a leg support arrangement of the previously mentioned kind in which a sufficient free space can be achieved between the leg supports.

This object is solved in accordance with the invention in that each leg support is connected with the base element by means of a parallelogram joint whose pivot axes are arranged perpendicular to the plane of the operating table support.

In the case of the inventive solution each leg support, by means of the parallelogram joint, is displaceable parallel to itself laterally outwardly. Thereby there exists between the leg supports an essentially larger free space than would be possible with a similar spreading of the patient's legs with the customary leg supports which are movable about spreading joints near the hips.

In many applications not only the legs of the patient have to be spread apart but also the lower leg has to be bent. For this, leg support arrangements are known in which each leg support has an upper leg support and a lower leg support each of which is pivotal by a folding joint about a horizontal axis relative to the base element and relative to one another, as for example shown in U.S. Pat. No. 6,276,012 B2. In accordance with the invention, for such a leg support arrangement it is proposed that each upper leg support is connected to a connecting piece by two links forming the parallelogram joint, to which connecting piece the first ends of the links are joined and which connecting piece is connected to the base element for pivotal movement about the folding axis for the upper leg support, and the second ends of the links are pivotally connected to the upper leg support to which the folding joint for the lower leg support is connected.

The inventive solution has the advantage that both the folding axes for the upper leg supports as well as the folding axes for the lower leg supports both maintain their orientation in space when the leg supports are moved away from or toward one another. It is therefore assured that the lower leg supports upon angularly adjusting the leg supports, that is upon the upward pivoting of the upper leg support and the folding down of the lower leg support, these do not become inclined. Thereby a sliding of the lower leg laterally from the lower leg support is inhibited.

In a preferred embodiment the upper leg support is not formed as one piece but instead includes a connecting member and an upper leg plate connected to the connecting member in a releasable fashion with the links being pivotally connected to the connecting member and with the folding joint for the lower leg support being formed on the connecting member. The lower leg support also preferably includes a lower leg strut and a lower leg support plate releasably connected to the strut. The connecting member together with the links of the parallelogram joint and the lower leg strut thereby form a carrier structure for the leg plates of the upper leg support and the lower leg support which plates can be exchanged for others if needed.

To be able to further open the space between the leg supports it is advantageous if the lower leg strut is connected with a joint arm by means of a spreading joint, which joint arm is connected to the connecting member by means of the folding joint for the lower leg support, with the axis of the spreading joint being perpendicular to the axis of the folding joint and perpendicular to the plane of the lower leg support plate. The sequence of the joint arrangement—as seen in going from the base element to the lower leg support—in connection with the parallel guiding of the upper leg support assures that the lower leg support plates even in the case of pivoted and spread apart upper leg supports always pivot about a horizontal folding axis and thereby foreclose a tilting of the lower leg support plates about a longitudinal axis.

Preferably the connecting piece is insertable into a receiver fixed to the operating table, which receiver is a part of the folding hinge for the upper leg support. Therefore the leg plates can be quickly and easily connected to the base element or removed from it and, as the case may be, may be exchanged for other leg supports.

BRIEF DESCRIPTION OF THE DRAWINGS

The following description along with the accompanying drawings explains the invention by way of an exemplary embodiment. The drawings are.

DETAILED DESCRIPTION OF THE INVENTION

Figure 1:
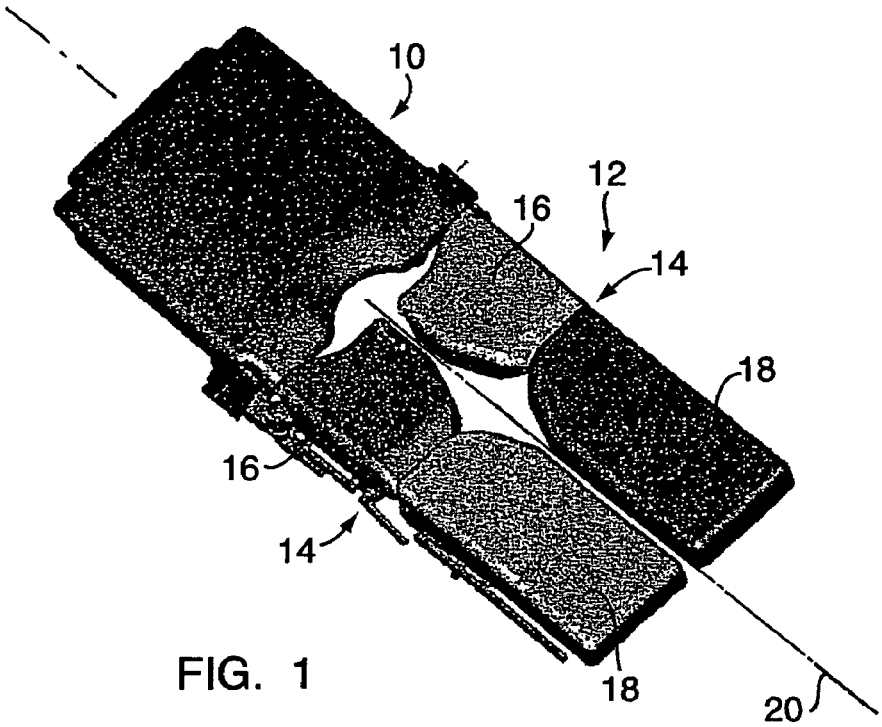
FIG. 1 is a perspective view at an angle from above onto a leg support arrangement connected with a base element of an operating table with the leg supports in closed position.
Figure 2:
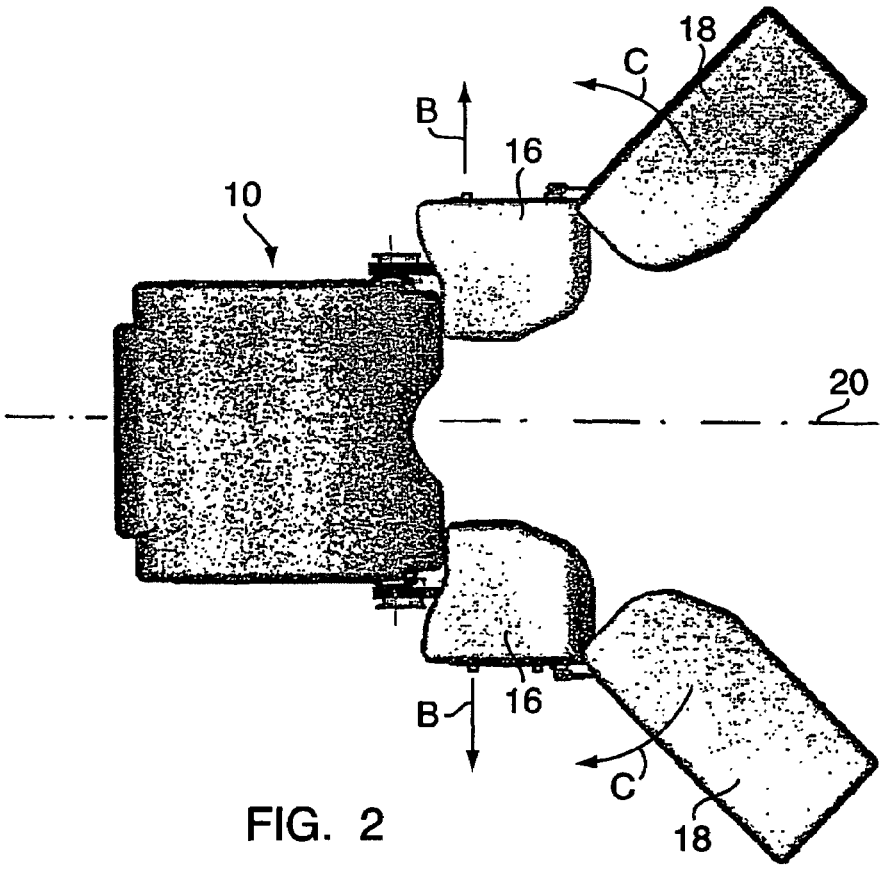
FIG. 2 is a plan view of the arrangement according to FIG. 1 with the leg supports in spread position.

Illustrated in FIG. 1 is a portion of a patient support surface or operating table plate with a base element 10, which element is usually connected to or connectable to the column head of a support column of an operating table. Connected with the base element 10 is a leg support arrangement 12 having two leg supports 14. Each leg support 14 has an upper leg support 16 and a lower leg support 18. The upper leg supports 16 are connected with the base element 10 and lower leg supports 18 are connected with the associated upper leg supports 16 by way of joints so that the upper leg supports 16 and the lower leg supports 18 can be adjusted to different positions. FIG. 1 shows the leg supports 12 and their parts 16, 18 in a fundamental position in which the leg supports 12 are oriented parallel to the longitudinal middle axis 20 of the operating table plate and lie close to one another. FIG. 2 shows the arrangement according to FIG. 1 in a spread position, in which the upper leg supports 16 have been shifted in the direction of the arrow B parallel to themselves outwardly, while the lower leg supports 18 each have been pivoted in the direction of the arrow C outwardly relative to the associated upper leg supports 16 about a spreading axis perpendicular to the picture plane.

Figure 3:
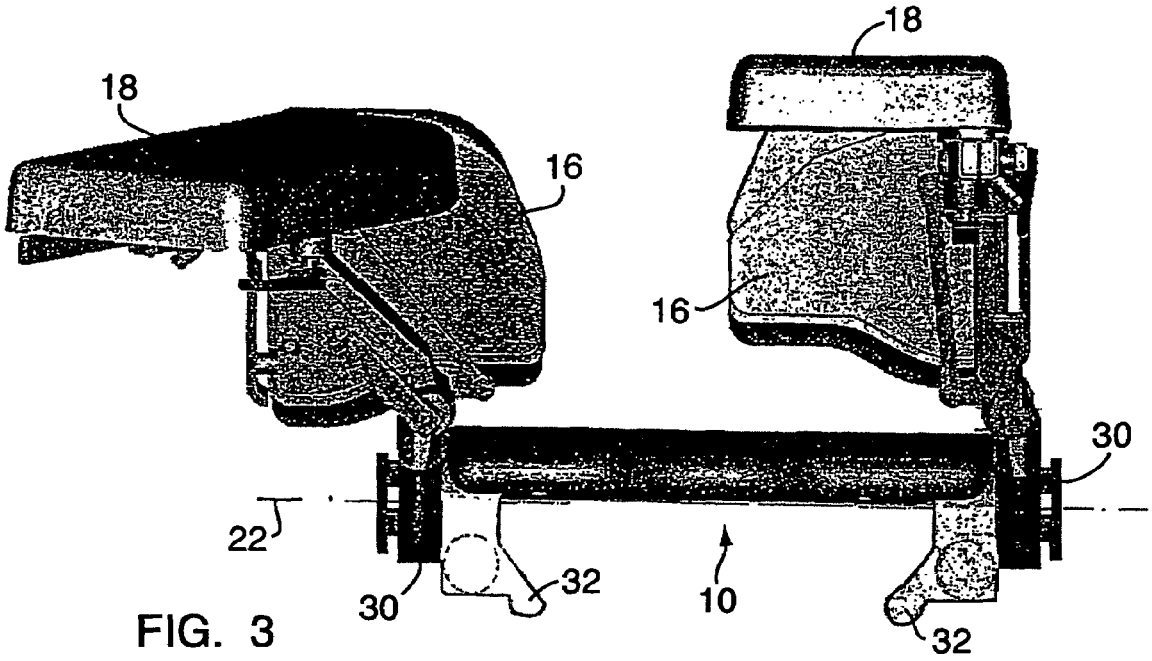
FIG. 3 is a view of the leg support arrangement from the foot-end with angularly adjusted leg supports.

FIG. 3 shows a position in which the upper leg supports 16 of both legs supports 14 have been folded about a horizontal folding axis 22 perpendicularly upwardly; with the left upper leg support 16 in FIG. 3 simultaneously having been shifted outwardly in the direction of the arrows B. The lower leg supports 18 of both leg supports 14 have each been folded about a horizontal folding axis with respect to the associated upper leg support 16 into the horizontal position, with the left lower leg support 18 in FIG. 3 additionally having been pivoted about its spreading axis outwardly.

Figure 4:
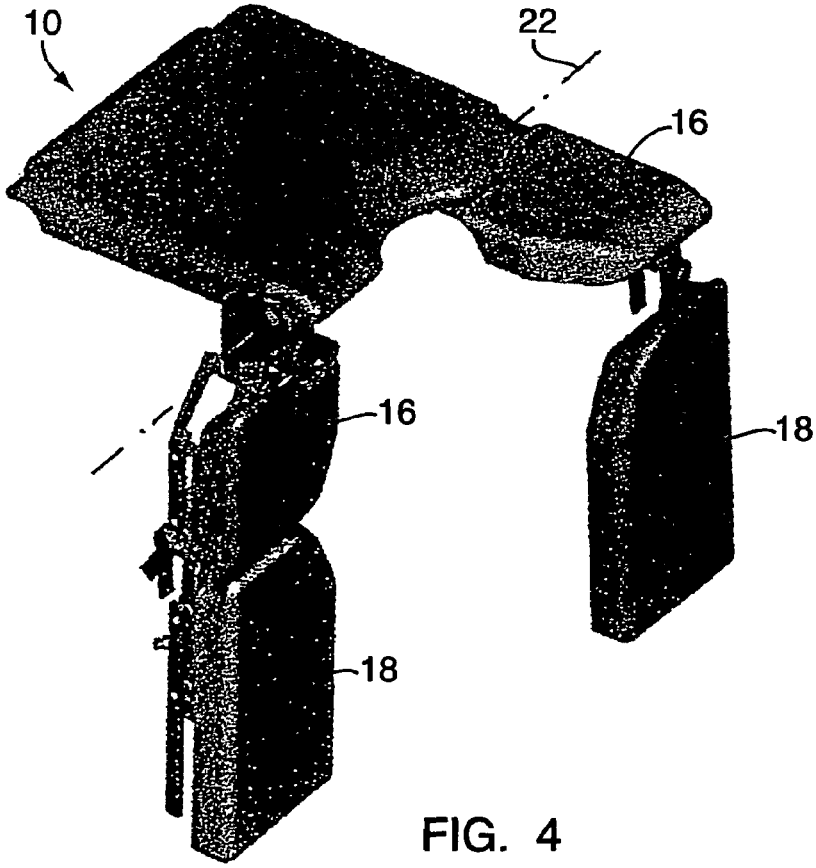
FIG. 4 is a perspective view of the arrangement illustrated in FIG. 1 with one leg support swung entirely downwardly and one leg support with a downwardly folded lower leg support.

Finally, FIG. 4 shows a position in which the left leg support in FIG. 4 in its entirety is pivoted downwardly about the horizontal folding axis 22, while in the case of the right leg support 14 only the lower leg support 18 is folded so as to extend vertically downwardly.

The construction of the carrier structure of each leg support with its joints, which make possible the previously illustrated movements of the upper leg supports and lower leg supports will now be explained with reference to FIGS. 5 to 7.

Figure 5:
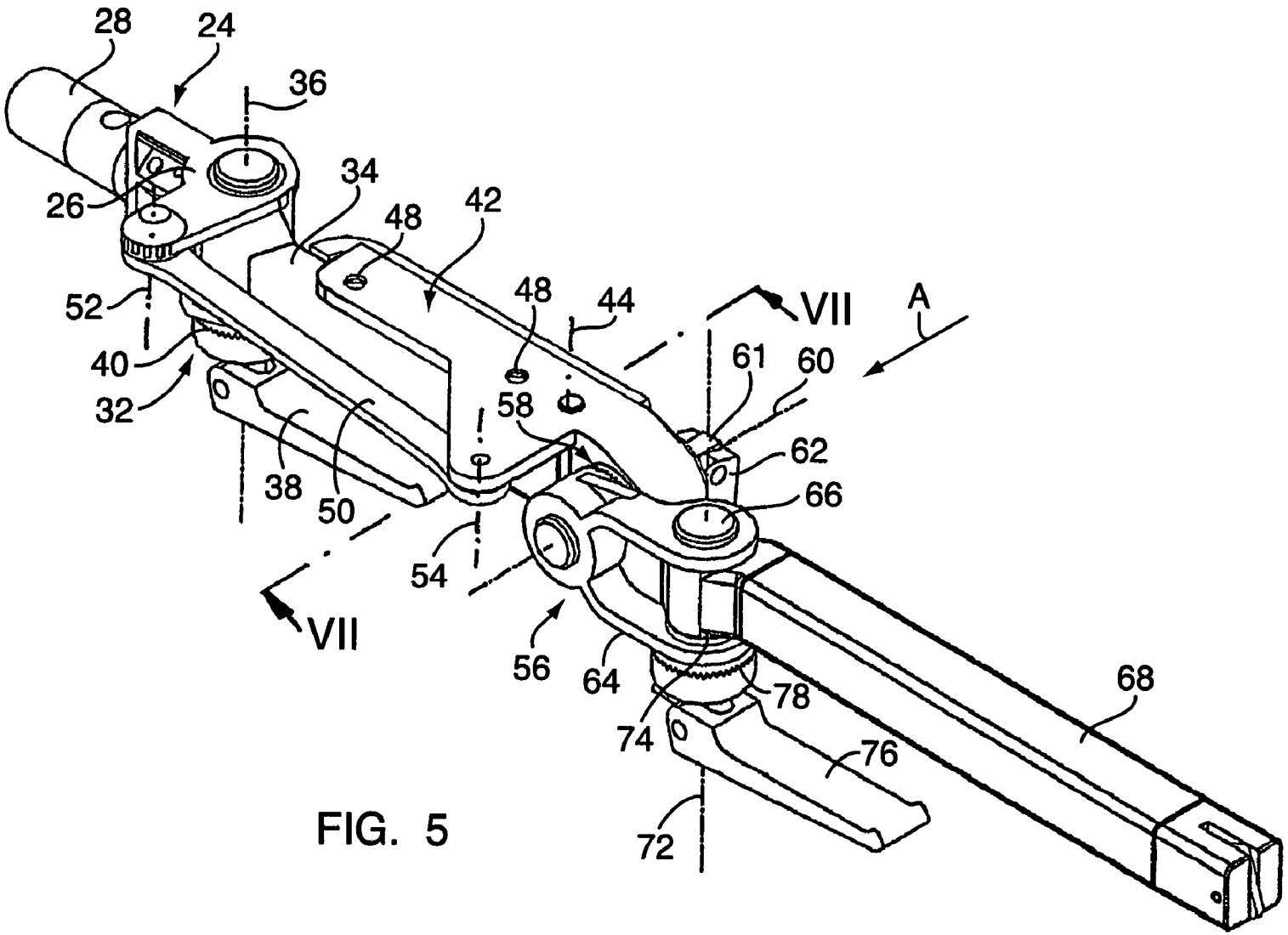
FIG. 5 is a perspective illustration of the carrier structure of one leg support.

In FIG. 5 is seen a connecting piece indicated generally at 24 having a joint fork 26 and a shank 28 rigidly fixed to the joint fork. By means of this shank, the connecting piece 24 can be inserted into a receiver 30 which is pivotally connected to the base element 10 for movement about the horizontal folding axis 22. The receiver 30 can be clamped in a desired pivotal position about the axis 22 by a clamping mechanism 32, which in itself is known and therefore not illustrated in more detail. The connecting piece 24 can be anchored in the receiver 30 in a non-illustrated way. The folding joint along with the folding axis 22 could also be integrated into the connecting piece 24.

A first link 34 is pivotally supported in the joint fork 26 of the connecting piece 24 for movement about a pivot axis 36, and with the help of an eccentric clamping mechanism 37, known in itself, with a tensioning lever 38 and toothed disks 40, can be fixed in a desired pivotal position about the axis 36. The link 34 at its other end is pivotally connected with a connecting member 42 for movement about a joint axis 44. The connecting member 42 is plate-shaped and serves for holding an upper leg plate 46, which can be fastened to the connecting member 42 by non-illustrated screws passing through bores 48 in the connecting member 42. The connecting member 42 and the upper leg plate 46 together form the upper leg support 16. The joint fork 26 and the connecting member 42 are further connected with one another by a second link 50, which link 50 at one end is pivotally connected to the joint fork 28 for movement about an axis 52 and at its other end is pivotally connected to the connecting member 42 for movement about an axis 54. The two links 34 and 50 form with their joint axes 36, 52 and 44, 54 a parallelogram joint, by means of which the connecting member 42 and with it the upper leg plate 46 can be adjusted parallel to itself without it changing its orientation in space.

At the end of the connecting member 42 remote from the connecting piece 24 is a joint arm 56 which by means of a folding joint 58 is pivotally supported for movement about a horizontal folding axis 60. The joint arm 56 can with the help of an eccentric clamping mechanism 61, operable by a clamping lever 62, be fixed in a desired folded position. The eccentric clamping mechanism 61 is made in a way similar to that of the clamping mechanism 37 intended for fixing the first link 34.

The joint arm 56 has a joint fork 64 which forms a spreading joint 66 for a lower leg strut 68. The lower leg strut 68 serves for holding a lower leg plate 70. The spreading axis 72 of the spreading joint 66 is arranged perpendicular to the folding axis 60 and to the plane of the lower leg plate 70. The spreading joint 66 can be clamped by means of an eccentric clamping mechanism 74 which like the previously mentioned clamping mechanisms includes a clamping lever 76 and toothed disks 78.

Figure 6:
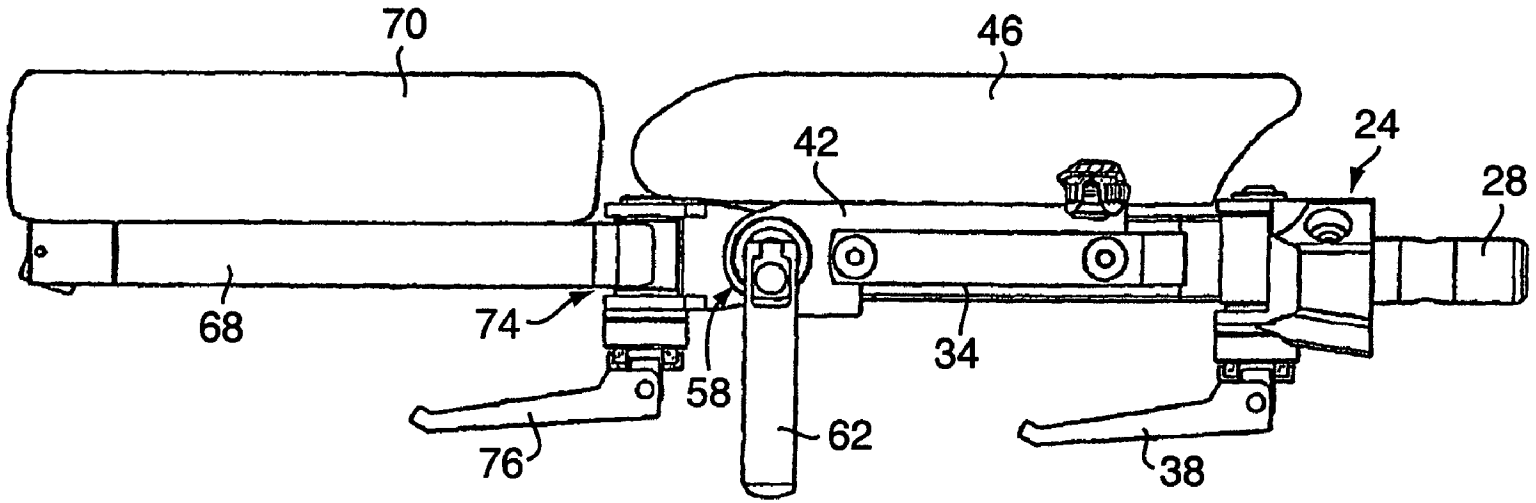
FIG. 6 is a side view of the structure illustrated in FIG. 5 taken in the direction of the arrow A in FIG. 5 with mounted plates.
Figure 7:
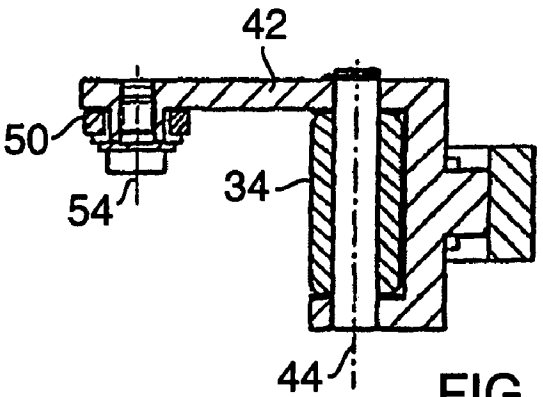
FIG. 7 is a section taken through the carrier structure along the line VII-VII in FIG. 5.

The carrier structure illustrated in FIGS. 5 to 7 is completed by the upper leg plate 46 and the lower leg plate 70 as is indicated in FIG. 6.

Each upper leg support 16, or the leg support 14 in its entirety, can first of all be pivoted upwardly and downwardly about the folding axis 22 relative to the base element 10. Further the upper leg support 16, or the leg support in its entirety, with the help parallelogram joints 34, 40, 36, 52, 44, 54 can be displaced laterally relative to the base element 10, as is illustrated in FIG. 2. The lower leg support 18 can on one hand be pivoted relative to the upper leg support 16 about the horizontal folding axis 60 (FIGS. 3 and 4) and on the other hand can be rotated about the spreading axis 72 (FIG. 2). Because of the fact that the upper leg support 18 is adjustable by means of the parallelogram joint the two folding axes 22 and 60 always remain parallel to one another and horizontal. As a result of this the lower leg support in all of its possible positions remains stable with reference to its longitudinal middle axis, that is it is not tilted laterally. Therefore it is avoided that the leg of a patient can slip off of the lower leg support, which would require it additionally having to be fixed in place. From a comparison of FIGS. 1 and 2 it will further be seen immediately that by outward pivoting of the leg supports about vertical spreading axes lying at the connecting spotted between the base element 10 and the upper leg supports 16 only a relatively small free space can be achieved between the two leg supports, whereas the lateral shifting of the leg supports with the help of the associated parallelogram joints provides a greater free space.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A leg support arrangement for an operating table with two leg supports, which leg supports are so connected with a base element of an operating table that they are adjustable between a fundamental position in which they lie close to one another parallel to the longitudinal middle axis of the operating table and a spread position in which they have a spacing from the longitudinal middle axis, wherein each leg support is connected with the base element by means of a parallelogram joint whose joint axes are oriented perpendicular to the plane of the base element, wherein each leg support includes an upper leg support and a lower leg support each of which is movable by a folding joint about a horizontal axis relative to the base element and are pivotal relative to one another, that each upper leg support is connected with a connecting piece by two parallelogram joint forming links, to which connecting piece the first ends of the links are pivotally connected and which connecting piece is pivotally connected with the base element for movement about the folding axis for the upper leg support, and that the second ends of the links are pivotally connected to the upper leg support onto which the folding joint for the lower leg support is formed.

2. The leg support arrangement according to claim 1, wherein the upper leg support includes a connecting member and an upper leg plate releasably connected with the connecting member, with the Links being pivotally connected to the connecting member and with the folding joint for the lower leg support being formed on the connecting member.

3. The leg support arrangement according to claim 1, wherein the lower leg support includes a lower leg strut and a lower leg plate releasably connectable with the lower leg strut.

4. The leg support arrangement according to claim 3, wherein the lower leg strut is connected by a spreading joint with a joint arm which is connected with the connecting member by means of the folding joint for the lower leg support, with the axis of the spreading joint being oriented perpendicular to the axis of the folding joint and perpendicular to the plane of the lower leg support plate.

5. The leg support arrangement according to claim 1, wherein the connecting piece is insertable into a receiver fixed to the operating table, which receiver is part of the folding joint for the upper leg support.

* * * * *